US011841658B2

(12) United States Patent
Akamatsu et al.

(10) Patent No.: US 11,841,658 B2
(45) Date of Patent: Dec. 12, 2023

(54) FIXING APPARATUS WITH A DETECTION ELEMENT DISPOSED IN A HOLE PORTION OF A HEATER HOLDER MEMBER AND IMAGE FORMING APPARATUS

(71) Applicant: CANON KABUSHIKI KAISHA, Tokyo (JP)

(72) Inventors: Takaaki Akamatsu, Kanagawa (JP); Toru Imaizumi, Kanagawa (JP); Koji Yasui, Kanagawa (JP); Yosuke Naito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/946,163

(22) Filed: Sep. 16, 2022

(65) Prior Publication Data

US 2023/0097051 A1 Mar. 30, 2023

(30) Foreign Application Priority Data

Sep. 29, 2021 (JP) ..... 2021-159605

(51) Int. Cl.
*G03G 15/20* (2006.01)

(52) U.S. Cl.
CPC ..... *G03G 15/2053* (2013.01); *G03G 15/2039* (2013.01); *G03G 15/2064* (2013.01); *G03G 2215/2038* (2013.01)

(58) Field of Classification Search
CPC ..... G03G 15/2053; G03G 15/2039; G03G 15/2064
USPC ..... 399/328
See application file for complete search history.

(56) References Cited

U.S. PATENT DOCUMENTS

| | | | |
|---|---|---|---|
| 9,977,381 | B2 | 5/2018 | Yasui et al. |
| 10,197,955 | B2 | 2/2019 | Mochizuki |
| 11,402,774 | B2 | 8/2022 | Imaizumi |
| 2018/0088497 | A1 | 3/2018 | Yasui |
| 2021/0063928 | A1 | 3/2021 | Uehara et al. |

FOREIGN PATENT DOCUMENTS

| | | | | |
|---|---|---|---|---|
| JP | 2001-102150 | A | 4/2001 | |
| JP | 2004281286 | A | * 10/2004 | ..... G03G 15/2053 |
| JP | 2017-198457 | A | 11/2017 | |
| JP | 2021-039147 | A | 3/2021 | |
| JP | 2021-071705 | A | 5/2021 | |

* cited by examiner

*Primary Examiner* — Quana Grainger
(74) *Attorney, Agent, or Firm* — Venable LLP

(57) ABSTRACT

A fixing apparatus includes a first rotary member, a nip forming unit including a heater and a holder member, a second rotary member, and a support member. The holder member includes a first surface configured to support the heater and provided on the nip portion side of the holder member in an orthogonal direction orthogonal to both of a longitudinal direction and a short direction, a second surface provided on a side of the holder member opposite to the first surface in the orthogonal direction and configured to abut a first abutting portion of the support member and abut a second abutting portion of the support member, and a rib portion provided to project from the second surface and extend in the short direction throughout at least a range in the short direction where the first surface is provided.

11 Claims, 11 Drawing Sheets

FIXING APPARATUS WITH A DETECTION ELEMENT DISPOSED IN A HOLE PORTION OF A HEATER HOLDER MEMBER AND IMAGE FORMING APPARATUS

BACKGROUND OF THE INVENTION

Field of the Invention

The present invention relates to a fixing apparatus that fixes an image to a recording medium and an image forming apparatus that forms an image on a recording medium.

Description of the Related Art

An image forming apparatus of an electrophotographic system or the like includes a fixing apparatus of a thermal fixation system that heats and fixes a toner image transferred onto a recording material. Japanese Patent Laid-Open No. 2001-102150 discloses a fixing apparatus of a film heating system including a heater in which a heat-generating resistor is formed on a ceramic substrate, a holder member that holds the heater, a tubular film fitted on the heater, and a pressurizing roller in pressure contact with the heater with the film therebetween. In addition, this document discloses efficiently heating the film by dispersing particles having a low thermal conductivity in the holder member.

However, in the case where the fixing apparatus is used for a long period, the holder member creeps in some cases by being continuously subjected to heat and load. For example, in the case where the holder member creeps in the configuration of the above-described document, the rotation trajectory of the film rotating around the holder member changes, and an influence thereof can appear as deterioration of the fixing performance caused by reduction of the contact area between the film and the heater or the like.

SUMMARY OF THE INVENTION

The present invention provides a fixing apparatus and an image forming apparatus that can achieve stable fixing performance for a long period.

According to one aspect of the invention, a fixing apparatus includes a first rotary member configured to rotate, a nip forming unit including a heater and a holder member and disposed in an inner space of the first rotary member, the heater having a length in a longitudinal direction thereof larger than a length thereof in a short direction orthogonal to the longitudinal direction, the holder member being configured to hold the heater, a second rotary member configured to be in a pressure contact with the nip forming unit with the first rotary member therebetween to form a nip portion between the second rotary member and the nip forming unit, the first rotary member and the second rotary member being configured to nip a recording material at the nip portion and convey the recording material from a first side toward a second side in the short direction, and a support member disposed in the inner space of the first rotary member and configured to support the nip forming unit, wherein the holder member includes a first surface configured to support the heater and provided on the nip portion side of the holder member in an orthogonal direction orthogonal to both of the longitudinal direction and the short direction, a second surface provided on a side of the holder member opposite to the first surface in the orthogonal direction and configured to abut a first abutting portion of the support member on the first side in the short direction with respect to the first surface and abut a second abutting portion of the support member on the second side in the short direction with respect to the first surface, and a rib portion provided to project from the second surface and extend in the short direction throughout at least a range in the short direction where the first surface is provided.

Further features of the present invention will become apparent from the following description of exemplary embodiments with reference to the attached drawings.

DESCRIPTION OF THE EMBODIMENTS

Embodiments according to the present disclosure will be described below with reference to drawings.

First Embodiment

Image Forming Apparatus

Figure 1:
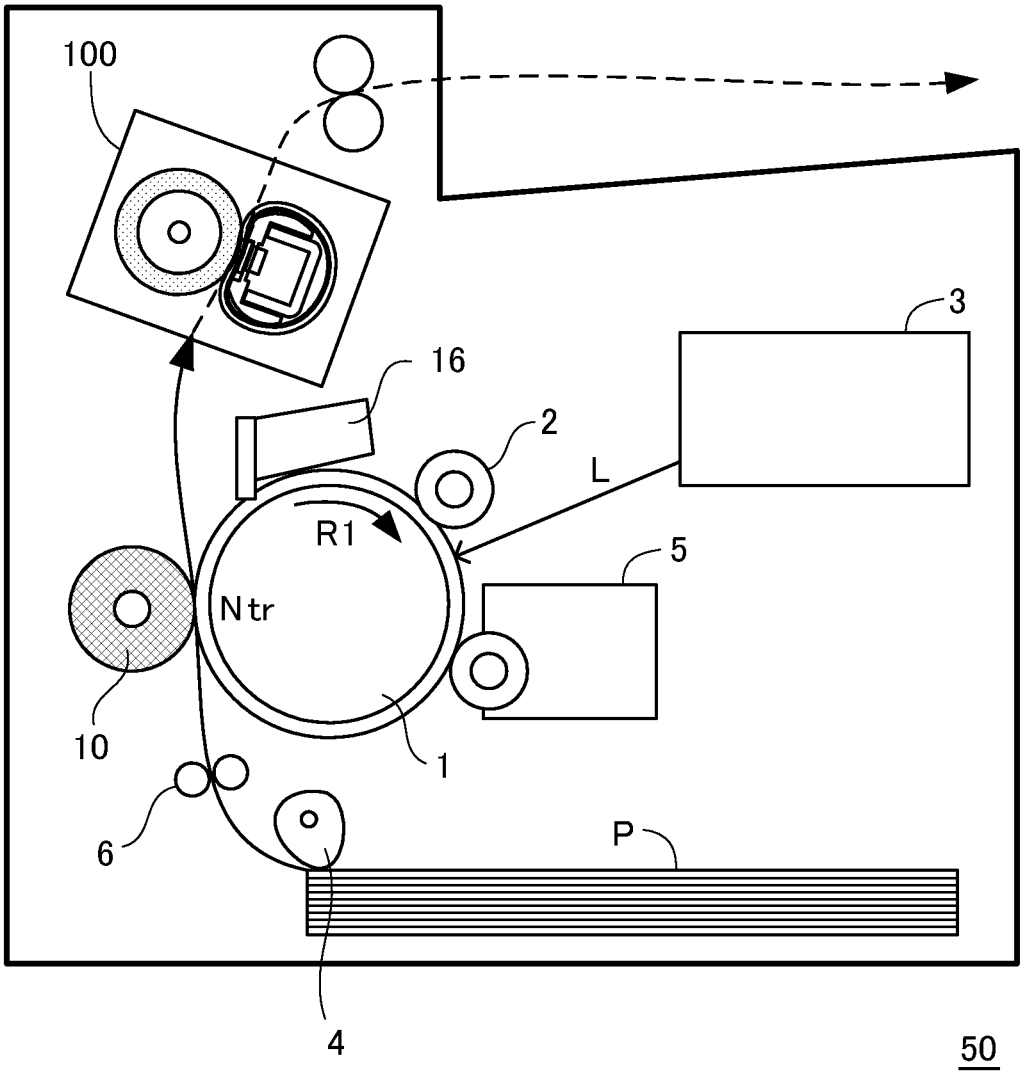
FIG. 1 is a schematic view of an image forming apparatus according to a first embodiment.

An image forming apparatus according to a first embodiment will be described with reference to a schematic view illustrated in FIG. 1. An image forming apparatus 50 according to the present embodiment is an electrophotographic apparatus of a direct transfer system that directly transfers a toner image formed on a photosensitive drum 1 onto a recording material P. That is, the image forming apparatus 50 transfers the toner image onto the recording material P without an intermediate transfer member.

The image forming apparatus 50 includes, as an image forming portion, an electrophotographic unit including a photosensitive drum 1, a charging unit 2, an exposing unit 3, a developing unit 5, a transfer roller 10, and a drum cleaner 16. The photosensitive drum 1 serving as an image bearing member is an electrophotographic photoconductor formed in a drum shape, that is, a cylindrical shape. The charging unit 2, the exposing unit 3, the developing unit 5, the transfer roller 10, and the drum cleaner 16 are arranged around the photosensitive drum 1 in this order in a rotation direction of the photosensitive drum 1 indicated by an arrow R1.

When an image formation request is input to the image forming apparatus 50 from an external computer, the photosensitive drum 1 is rotationally driven in the arrow R1 direction, and the surface of the photosensitive drum 1 is charged to a predetermined polarity, which is a negative polarity in the present embodiment, by the charging unit 2. Then, the charged surface of the photosensitive drum 1 is irradiated with laser light L from the exposing unit 3, and an electrostatic latent image is formed on the surface of the photosensitive drum 1. The developing unit 5 accommodates black toner serving as developer of the present embodiment, and supplies negatively-charged black toner to the photosensitive drum 1 via a developing roller. As a result of this, toner attaches to the electrostatic latent image region on the photosensitive drum 1, and thus a toner image is formed on the surface of the photosensitive drum 1.

A feed tray on which recording materials P are supported is provided in a lower portion of the image forming apparatus 50. As the recording materials P, various sheet materials of different sizes and materials can be used. Examples of the various sheet materials include paper sheets such as plain paper sheets and cardboards, plastic films, cloths, surface-treated sheet materials such as coated paper sheets, and sheet materials of irregular shapes such as envelops and index paper sheets.

The recording materials P supported on the feed tray are fed one by one by a feed roller 4, and are conveyed by conveyance rollers 6 to a transfer nip Ntr serving as a transfer portion where a toner image is transferred onto the recording material P. The transfer nip Ntr is a nip portion between the photosensitive drum 1 and the transfer roller 10. Then, a voltage of a positive polarity, which is a polarity opposite to the normal charging polarity of the toner, is applied to the transfer roller 10 from an unillustrated power source, and thus the toner image on the photosensitive drum 1 is transferred onto the recording material P in the transfer nip Ntr. Attached matter such as transfer residual toner and paper dust attaching to the surface of the photosensitive drum having passed the transfer nip Ntr is removed by the drum cleaner 16 including an elastic blade.

The recording material P on which the toner image has been transferred is conveyed to a fixing apparatus 100 of a thermal fixation system that will be described below, and the toner image is subjected to a fixing process. The recording material P having passed the fixing apparatus 100 is discharged as a product to the outside of the image forming apparatus 50 by a discharge roller pair.

To be noted, although an image forming apparatus of a direct transfer system has been described as an example, an image forming apparatus of a different system may be used as long as the image forming apparatus includes a fixing apparatus that heats and fixes a toner image formed on the recording material P For example, a fixing apparatus that will be described below may be applied to an image forming apparatus of an intermediate transfer system in which a toner image formed on an image bearing member is transferred onto an intermediate transfer member such as an intermediate transfer belt through primary transfer and then the toner image is transferred from the intermediate transfer member onto a recording material. In addition, the fixing apparatus that will be described below may be applied to an image forming apparatus that forms a color image on a recording material by using toner of a plurality of colors.

Fixing Apparatus

Figure 2A:
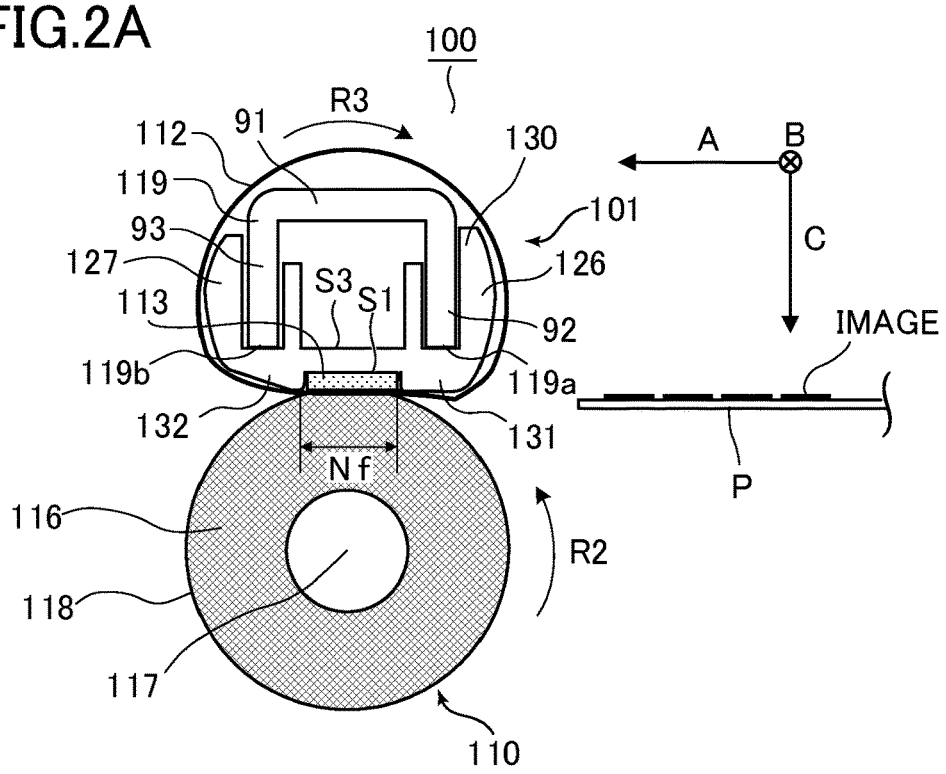
FIGS. 2A and 2B are each a schematic view of a fixing apparatus according to the first embodiment.
Figure 2B:
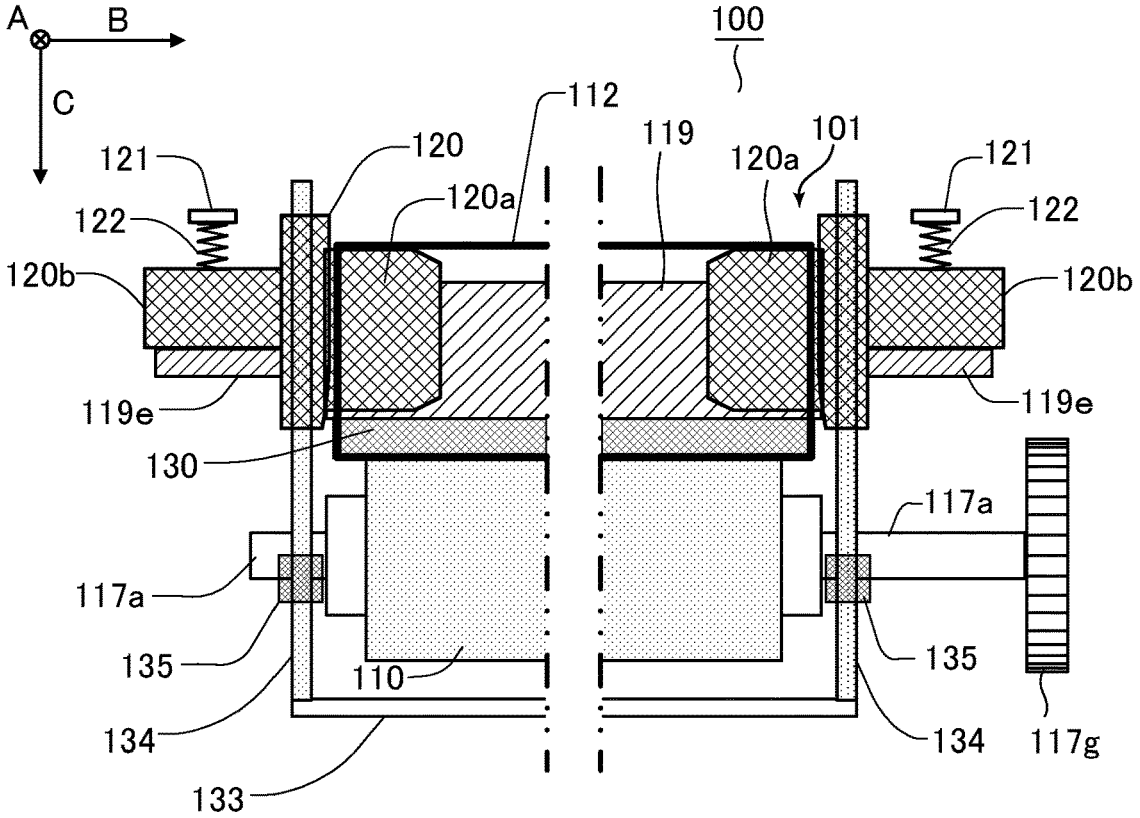

Summary of the fixing apparatus 100 of the present embodiment will be described with reference to FIGS. 2A and 2B. The fixing apparatus 100 of the present embodiment is a fixing apparatus of a film heating system that is excellent in shortening the activation time and reducing the power consumption. FIG. 2A is a section view of the fixing apparatus 100 taken at a center portion thereof in the longitudinal direction. FIG. 2B is a section view taken along the longitudinal direction of the fixing apparatus 100, and illustrates only end portions of the fixing apparatus 100 in the longitudinal direction.

In the description below, the shapes and positional relationships of members in the fixing apparatus 100 will be described by using a recording material conveyance direction A, a longitudinal direction B, and an orthogonal direction C. The recording material conveyance direction A is a conveyance direction of the recording material P in a fixing nip Nf that is a nip portion of the fixing apparatus 100. The longitudinal direction B is a width direction of the recording material P in the fixing nip Nf. The longitudinal direction B is orthogonal to the recording material conveyance direction A, and also serves as a main scanning direction in image formation. The orthogonal direction C is an orthogonal direction orthogonal to both the recording material conveyance direction A and the longitudinal direction B.

As illustrated in FIGS. 2A and 2B, the fixing apparatus 100 includes a film unit (film assembly) 101 including a fixing film 112, a heater 113, a heater holder 130, and a pressurizing stay 119, and a pressurizing roller 110 opposing the film unit 101. The fixing film 112, the heater 113, the heater holder 130, the pressurizing stay 119, and the pressurizing roller 110 are each a member having a thin elongated shape that is longer in the longitudinal direction B. That is, the longitudinal direction B of the fixing apparatus 100 also serves as the longitudinal direction of the fixing film 112, the heater 113, the heater holder 130, the pressurizing stay 119, and the pressurizing roller 110. In addition, the recording material conveyance direction A also serves as a short direction of the heater 113, and the orthogonal direction C also serves as a thickness direction of the heater 113. That is, the heater 113 is a member whose length in the longitudinal direction B is larger than the length thereof in the short direction orthogonal to the longitudinal direction B. In the present embodiment, the short direction is the recording material conveyance direction A. In addition, in the fixing nip Nf, the recording material P is conveyed from a first side of the heater 113 in the short direction toward a second side of the heater 113 in the short direction. The first side is the upstream side in the recording material conveyance direction A, and the second side is the downstream side in the recording material conveyance direction A.

The heater holder 130 serves as a holder member or a holding member in the present embodiment. The pressurizing stay 119 serves as a support member or a reinforcing member in the present embodiment. The pressurizing roller 110 serves as a second rotary member in the fixing apparatus 100 of the present embodiment. In addition, the pressurizing roller 110 serves as a pressurizing member in the present embodiment.

The fixing film 112 serves as a first rotary member in the fixing apparatus 100 of the present embodiment. The fixing film 112 is a flexible tubular film member, that is, an endless belt member. The fixing film 112 of the present embodiment has an outer diameter of 18 mm in a cylindrical shape that is not deformed, and has a multilayer structure in the thickness direction. The layer configuration of the fixing film 112 at least includes a base layer for the strength of the film, and a release layer for reducing attachment of soiling to the surface thereof.

The material of the base layer preferably has a heat resistance to endure the heat of the heater 113 and a strength high enough to slide on the heater 113. Preferable examples of the base layer include metals such as stainless steel and nickel, and heat-resistant resins such as polyimide resin. In the present embodiment, polyimide resin to which carbon-based filler is added to improve the thermal conductivity and the strength is used as the material of the base layer of the fixing film 112. The thickness of the base layer is preferably 15 μm to 100 μm because the smaller the thickness of the base layer is, the more it is likely for the heat of the heater 113 to be transmitted to the surface of the recording material P but the lower the strength thereof becomes. In the present embodiment, the thickness of the base layer is set to 60 μm.

Preferable examples of the material of the release layer of the fixing film 112 include fluorine resins such as perfluoroalkoxy resin (PFA), polytetrafluoroethylene resin (PTFE), and tetrafluoroethylene-hexafluoropropylene resin (FEP). In the present embodiment, PFA, which is excellent in the releasing property and heat resistance among the fluorine resins, is used. The release layer may be formed by covering the base layer with a tube, or may be formed by coating the surface of the base layer with a coating liquid. In the present embodiment, the release layer is formed by the coating method that is excellent in formation of a thin layer. The thinner the release layer is, the more it is likely for the heat of the heater 113 to be transmitted to the surface of the fixing film 112, but it becomes difficult to secure the durability if the release layer is too thin. Therefore, the thickness of the release layer is preferably about 5 μm to 30 μm, and is set to 10 μm in the present embodiment. In addition, although it is not used in the present embodiment, an elastic layer may be provided between the base layer and the release layer. In this case, silicone rubber, fluorine rubber, or the like is used as the material of the elastic layer.

The heater holder 130 is provided on the inner circumferential side of the fixing film 112. The heater holder 130 has an approximately semicircular gutter shape in transverse section view, which is a section view taken along a plane orthogonal to the longitudinal direction B. That is, in the heater holder 130, a surface opposing the fixing nip Nf is curved in a convex shape protruding toward the pressurizing roller 110 side in the orthogonal direction C, and a heater holding portion serving as a fitting portion that holds the heater 113 is provided at an approximate center portion of the curved surface in the recording material conveyance direction A. The heater holding portion has a thin elongated groove shape that opens toward the pressurizing roller 110 side in the orthogonal direction C and is longer in the longitudinal direction B. The heater holder 130 is formed from liquid crystalline polymer resin having high heat resistance to satisfy requirements for heat resistance and stiffness. To be noted, in the present embodiment, as the liquid crystalline polymer resin, Sumika Super E5204L (registered trademark) manufactured by Sumitomo Chemical Co., Ltd. is used.

The heater holder 130 includes a heater seating surface S1 that supports the heater 113, an upstream projection portion 131 and a downstream projection portion 132 that are adjacent to the heater seating surface S1, and a stay contact surface S3 provided on the opposite side to the heater seating surface S1 in the orthogonal direction C. The heater seating surface S1 is a first surface of the heater holder 130 that is provided on the pressurizing roller 110 side in the orthogonal direction C orthogonal to both the recording material conveyance direction A and the longitudinal direction B. The heater seating surface S1 supports a surface of the heater 113 opposite to the pressurizing roller 110 in the orthogonal direction C, that is, a surface opposite to a sliding surface S2.

The upstream projection portion 131 is provided on the upstream side of the heater seating surface S1 in the recording material conveyance direction A, and projects toward the pressurizing roller 110 side in the orthogonal direction C with respect to the heater seating surface S1. The downstream projection portion 132 is provided on the downstream side of the heater seating surface S1 in the recording material conveyance direction A, and projects toward the pressurizing roller 110 side in the orthogonal direction C with respect to the heater seating surface S1. The heater seating surface S1 is a bottom portion of a groove shape serving as a heater holding portion formed between the upstream projection portion 131 and the downstream projection portion 132. In addition, the upstream projection portion 131 and the downstream projection portion 132 each include a sliding surface that slides on the inner surface of the fixing film 112 on the upstream side or downstream side of the sliding surface S2 of the heater 113 in the recording material conveyance direction A.

Further, the heater holder 130 includes an upstream guide 126 that guides the fixing film 112 on the upstream side of the fixing nip Nf in the recording material conveyance direction A, and a downstream guide 127 that guides the fixing film 112 on the downstream side of the fixing nip Nf. That is, the heater holder 130 has a function of holding the heater 113 and guiding the rotation of the fixing film 112.

Figure 6:
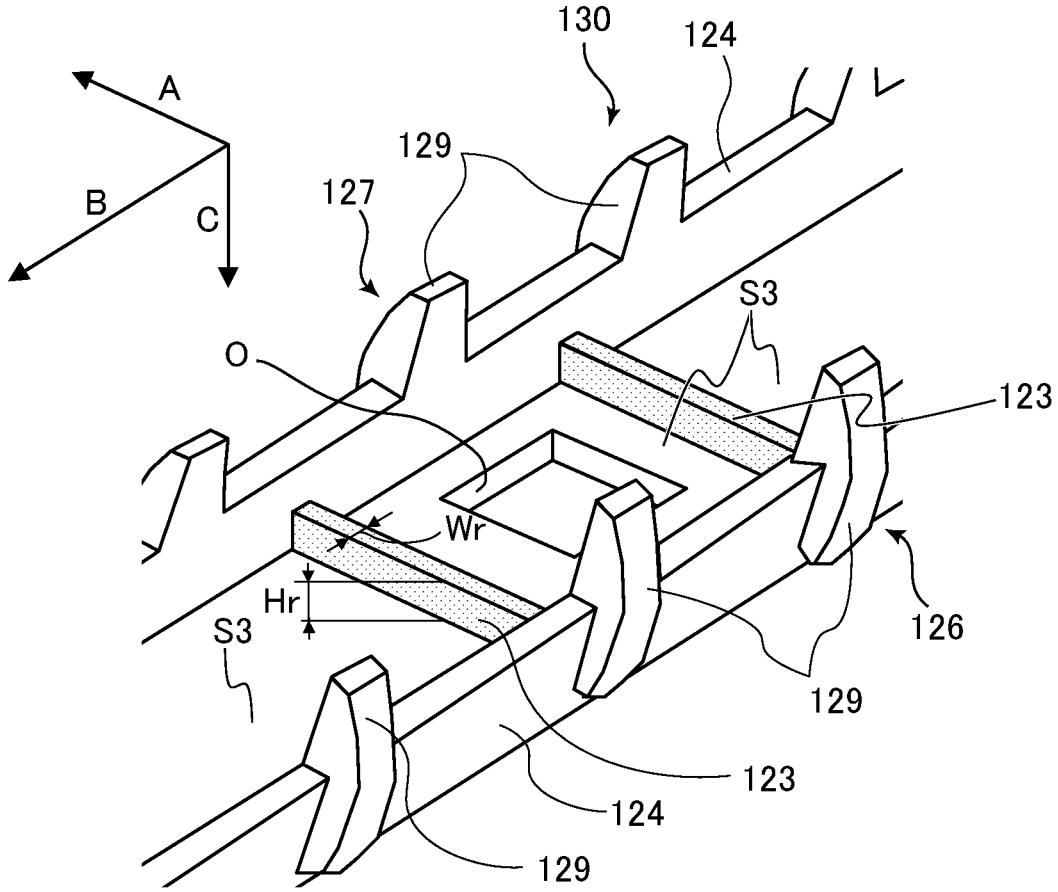
FIG. 6 is a diagram illustrating a rib portion of the heater holder according to the first embodiment.

The upstream guide 126 and the downstream guide 127 both extend to the side opposite to the pressurizing roller 110 in the orthogonal direction C with respect to the stay contact surface S3 of the heater holder 130. More specifically, as illustrated in FIG. 6, the upstream guide 126 and the downstream guide 127 each include a wall portion 124 erecting in the orthogonal direction C from an end portion of the stay contact surface S3 in the recording material conveyance direction A, and guide ribs 129 provided at a plurality of positions on the wall portions 124 in the longitudinal direction B. An end surface of the guide rib 129 is curved along a natural shape that is formed when the fixing film 112 is pressurized at the fixing nip Nf as described above and illustrated in FIG. 2A. The upstream guide 126 and the downstream guide 127 guide the rotation trajectory of the fixing film 112 by the end surfaces of the guide ribs 129. The upstream guide 126 is a first guide portion of the present embodiment that guides the inner surface of the fixing film 112 toward the fixing nip Nf. The downstream guide 127 is a second guide portion of the present embodiment that guides the inner surface of the fixing film 112 having passed the fixing nip Nf.

To be noted, instead of the configuration in which the fixing film 112 is guided by the guide ribs 129 projecting from the wall portions 124, a configuration in which the wall portions 124 themselves are formed in the same sectional shape as the guide ribs 129 of the present embodiment and the fixing film 112 is guided by the outer surface of the wall portions 124 may be employed. In this case, the guide ribs 129 may be formed to be continuous with the outer surface of the wall portions 124 and guide the fixing film 112 on the upstream side or the downstream side of the outer surface of the wall portions 124 in the rotation direction of the fixing film 112, or the guide ribs 129 may be omitted.

The heater 113 and the heater holder 130 are disposed in an inner space of the fixing film 112, and functions as a nip forming unit that is in pressure contact with the pressurizing roller 110 with the fixing film 112 therebetween to form the fixing nip Nf. To be noted, although a configuration in which the heater 113 directly slides on the inner surface of the fixing film 112 will be described in the present embodiment, a configuration in which a sliding member is provided between the heater 113 and the fixing film 112 may be employed. As the sliding member, a material having high thermal conductivity and high slidability on the inner surface of the fixing film 112 is used, and for example, a sheet member formed from ferroalloy or aluminum can be used. That is, the nip forming unit may have a configuration in which the heater 113 indirectly heats the fixing film 112 via the sliding member.

The pressurizing stay 119 is provided along the longitudinal direction B of the heater holder 130. The pressurizing stay 119 is formed by performing a bending process on a metal plate of a material having high rigidity such as stainless steel to uniformly pressurize the heater holder 130 in the longitudinal direction B. The pressurizing stay 119 is formed in an angular C shape opening toward the pressurizing roller 110 side in the orthogonal direction C as viewed in the longitudinal direction B. That is, the pressurizing stay 119 includes a first portion 91 extending in the recording material conveyance direction A, and a second portion 92 and a third portion 93 that respectively extend in the orthogonal direction C toward the heater holder 130 from the upstream end and the downstream end of the first portion 91 in the recording material conveyance direction A.

One end portion 119*a* of the pressurizing stay 119 is a first abutting portion that abuts the stay contact surface S3 of the heater holder 130 on the upstream side of the heater seating surface S1 in the recording material conveyance direction A, that is, on the first side of the heater 113 in the short direction. The other end portion 119*b* of the pressurizing stay 119 is a second abutting portion that abuts the stay contact surface S3 of the heater holder 130 on the downstream side of the heater seating surface S1 in the recording material conveyance direction A, that is, on the second side of the heater 113 in the short direction. That is, the pressurizing stay 119 abuts the stay contact surface S3 serving as a second surface of the heater holder 130 at the end portions 119*a* and 119*b* that respectively serve as distal ends of the second portion 92 and the third portion 93.

The pressurizing stay 119 presses the stay contact surface S3 toward the pressurizing roller 110 side in the orthogonal direction C at the end portion 119*a*, and thus supports the heater holder 130 against the nip pressure of the fixing nip Nf. That is, the pressurizing stay 119 functions as a support member that supports the nip forming unit including the heater 113 and the heater holder 130.

The pressurizing roller 110 of the present embodiment has an outer diameter of 20 mm, and is constituted by forming an elastic layer 116 having a thickness of 3.0 mm on the outer circumferential surface of a core metal 117 having a diameter of 14 mm and formed from iron. As the material of the elastic layer 116, solid rubber, foam rubber, or the like is used. The foam rubber has a low heat capacity and a low thermal conductivity, and is thus less likely to absorb the heat of the surface of the pressurizing roller 110 to the inside, thus the surface temperature thereof is likely to rise, and therefore the foam rubber is advantageous in shortening the activation time of the fixing apparatus 100. In the present embodiment, foam rubber obtained by foaming silicone rubber is used for the elastic layer 116. As the release layer, a release layer 118 formed from perfluoroalkoxy resin (PFA) is formed on the elastic layer 116. The release layer 118 may be formed by covering the elastic layer 116 with a tube similarly to the release layer of the fixing film 112, or formed by coating the surface of the elastic layer 116 with a coating liquid. In the present embodiment, the release layer 118 is formed by covering the outer circumferential surface of the elastic layer 116 with a tube having excellent durability. As the material of the release layer 118 other than PFA, fluorine resins such as PTFE and FEP, fluorine rubbers, silicone rubbers, and the like that have good releasability, and the like may be used. The width of the fixing nip Nf can be achieved at a lower pressure if the surface hardness of the pressurizing roller 110 is lower, but the surface hardness is also determined in consideration of the durability. In the present embodiment, a material having an Asker-C hardness (load: 4.9 N) of 50° is used. To be noted, a belt unit including a belt member stretched over a plurality of rollers may be used as the pressurizing member instead of the pressurizing roller 110.

As the heater 113 of the present embodiment, a heater formed by providing a heat-generating resistor on a ceramic substrate is used. Specifically, as the substrate of the heater 113, an alumina substrate having a width of 6 mm in the recording material conveyance direction A and a thickness of 1 mm in the orthogonal direction C is used. The heater 113 is formed by coating the surface of this substrate with an Ag/Pd (silver palladium) heat-generating resistor to a thickness of several μm by screen printing, and forming a glass layer having a thickness of 60 μm thereon for protection of the heat-generating resistor and improvement in the slidability.

The fixing apparatus 100 is configured such that the temperature of the heater 113 can be adjusted by appropriately controlling the current flowing in the heat-generating resistor in accordance with a signal of a temperature detection element (heat sensor) that will be described later and that detects the temperature of the substrate of the heater 113 or the fixing film 112. The heater 113 is supported in a fixed manner by being fit in the groove portion provided in the heater holder 130. In the present embodiment, the center of the heater 113 in the recording material conveyance direction A is positioned 0.4 mm upstream of the center (rotation axis) of the pressurizing roller 110.

As illustrated in FIG. 2B, the pressurizing stay 119 includes extension portions 119*e* extending to the outside of the side plates 134 constituting the frame 133 of the fixing apparatus 100 through the side plates 134 on both sides in the longitudinal direction B. A fixing flange 120 is fitted on each of the extension portions 119*e* on respective sides of the pressurizing stay 119. Since the fixing flanges 120 are supported by the side plates 134, the film unit 101 is attached to a space between the side plates 134 in an orientation in which the heater 113 is directed toward the pressurizing roller 110 in the orthogonal direction C. The fixing flanges 120 are each provided with an orthogonal groove portion extending in the orthogonal direction C, and the orthogonal groove portion is engaged with an edge portion of an orthogonal guide slit provided in the side plate 134. As a result of this, the fixing flanges 120 are respectively supported by the side plates 134 so as to be movable in the orthogonal direction C. In the present embodiment, a liquid crystalline polymer resin is used as the material of the fixing flanges 120.

The core metal 117 of the pressurizing roller 110 includes shaft portions 117*a* penetrating both the side plates 134, and the shaft portions 117*a* are each held by a bearing member 135 engaged with the side plate 134. As a result of this, the pressurizing roller 110 is rotatably supported by the frame 133.

Further, pressurizing springs 122 are respectively provided, in a compressed form, between pressurizing portions 120*b* of the fixing flanges 120 and spring support portions 121 fixed to the frame 133. As a result of this, the urging force of the pressurizing springs 122 is transmitted to the heater 113 via the fixing flanges 120 on both sides, the pressurizing stay 119, and the heater holder 130, and the heater 113 is pressed against the pressurizing roller 110 by a predetermined pressing force with the fixing film 112 therebetween.

In the present embodiment, the spring constant and the compression amount of the pressurizing springs 122 are set such that the pressing force by which the fixing film 112 and the pressurizing roller 110 press each other in the orthogonal direction C in the fixing nip Nf is 15 kgf. In the fixing nip Nf, the fixing film 112 is nipped between the heater 113 and the pressurizing roller 110 and is thus warped along the sliding surface S2 that is a flat front surface of the heater 113, and thus the inner surface of the fixing film 112 is in firm contact (surface contact) with the sliding surface S2. To be noted, film regulating portions 120*a* of the fixing flanges 120 are each formed in a shape following the natural shape that is formed when the fixing film 112 is pressurized in the fixing nip Nf as illustrated in FIG. 2A.

When a driving force transmitted from an unillustrated drive source is input to a drive gear 117*g* provided on one of the shaft portions 117*a* of the pressurizing roller 110 illustrated in FIG. 2B, the pressurizing roller 110 is rotationally driven in an arrow R2 direction of FIG. 2A at a predetermined speed. In accordance with this rotational driving of the pressurizing roller 110, a rotational force acts on the fixing film 112 due to the frictional force between the pressurizing roller 110 and the fixing film 112 in the fixing nip Nf. As a result of this, the fixing film 112 rotates in an arrow R3 direction in FIG. 2A around the heater 113 and the heater holder 130 in accordance with the rotation of the pressurizing roller 110 while the inner surface thereof is sliding on the sliding surface S2 of the heater 113. The rotation speed of the pressurizing roller 110 is set such that the surface moving speed of the pressurizing roller 110 and the fixing film 112 in the fixing nip Nf is 200 mm/sec.

When fixing the image, the pressurizing roller 110 is driven while supplying power to the heater 113, and thus the recording material is nipped and conveyed between the pressurizing roller 110 and the fixing film 112 in the fixing nip Nf. At the same time as this, the image on the recording material is heated by the fixing film 112 heated by the heater 113, and thus the image is thermally fixed.

To be noted, a heat-resistant lubricant is applied on the inner surface of the fixing film 112, and thus slidability of the inner surface of the fixing film 112 on the heater 113 and the heater holder 130 is secured. In the present embodiment, a fluorine-based grease is used as the lubricant. Specifically, a grease including a perfluoropolyether (PFPE) oil as a base oil and polytetrafluoroethylene (PTFE) powder as a thickener is used.

Heater Holder

Figure 3:
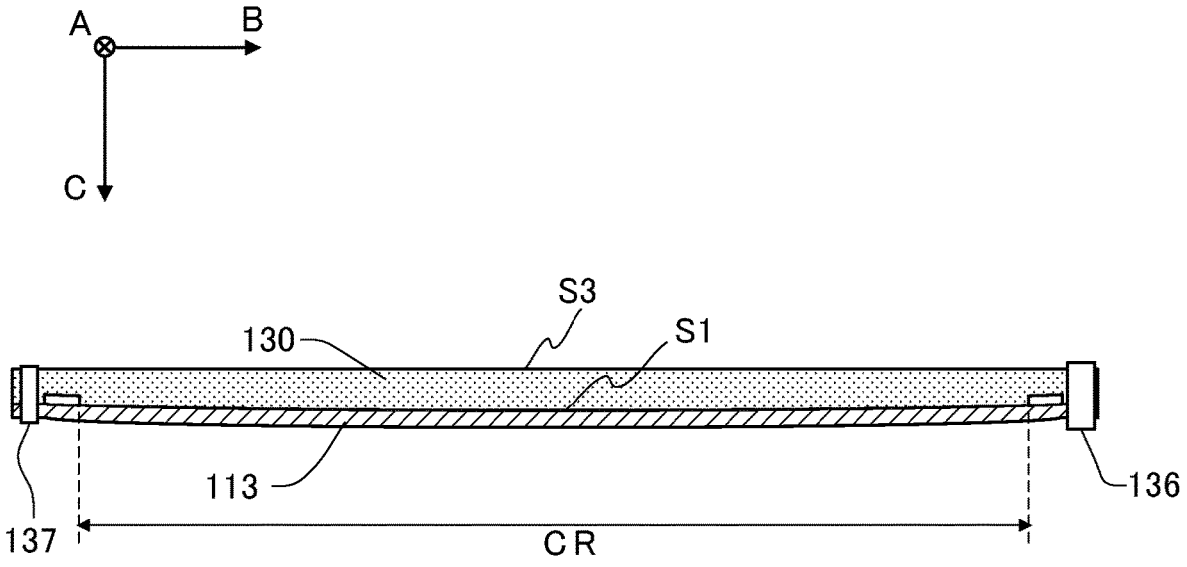
FIG. 3 is a diagram for describing a crown shape of a heater holder according to the first embodiment.

FIG. 3 is a schematic diagram for describing a crown shape of the heater holder 130 in the longitudinal direction B. As illustrated in FIG. 3, the heater holder 130 has a shape that is gently curved such that a center portion in the longitudinal direction B of the heater seating surface S1 supporting the heater 113 projects toward the pressurizing roller 110 side in the orthogonal direction C with respect to end portions thereof in the longitudinal direction B. That is, the heater holder 130 has a crown shape. End portions of the heater 113 in the longitudinal direction B are fixed to the heater holder 130 by a heater power supply portion 136 and a heater clip 137. Therefore, the heater 113 is attached to the heater holder 130 in a state of being curved along the crown shape of the heater seating surface S1.

As a specific example of the crown shape of the heater seating surface S1, the shape of the heater seating surface S1 is set to a shape of a gentle quadratic curve as viewed in the recording material conveyance direction A in a region CR having a longitudinal width of 225 mm and corresponding to a range in the longitudinal direction B where the heater 113 opposes the pressurizing roller 110. The projection amount by which the center portion of the heater seating surface S1 projects in the orthogonal direction C with respect to the end portions thereof is, for example, 0.4 mm.

By providing a crown shape like this, the fixing nip Nf having a constant width throughout approximately the entire region in the longitudinal direction B can be formed. That is, when the film unit 101 is pressed against the pressurizing roller 110 by the urging force of the pressurizing springs 122, the pressurizing stay 119 and the core metal 117 of the pressurizing roller 110 are slightly warped. In the case where the heater seating surface S1 is not formed in a crown shape, the heater 113 is strongly pressed by the pressurizing roller 110 at end portions thereof in the longitudinal direction B, and thus the nip width of the fixing nip Nf increases at the end portions. In contrast, the nip width of the fixing nip Nf is reduced at the center portion in the longitudinal direction B. However, by providing the crown shape of the present embodiment, the difference in the nip width of the fixing nip Nf between the center portion and the end portions in the longitudinal direction B can be reduced. The width of the fixing nip Nf in the recording material conveyance direction A in the present embodiment is about 6.2 mm throughout the entirety of the region CR in the longitudinal direction B.

Figure 4A:
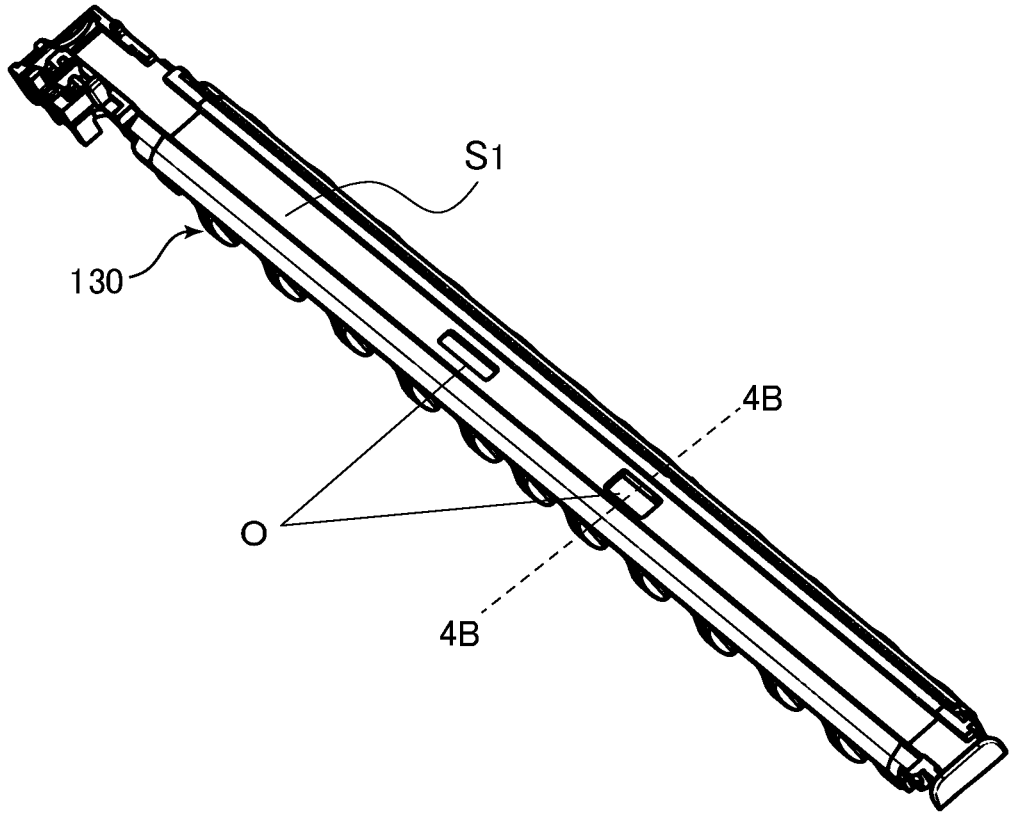
FIGS. 4A and 4B are each a diagram for describing a shape of an opening portion of the heater holder according to the first embodiment.
Figure 4B:
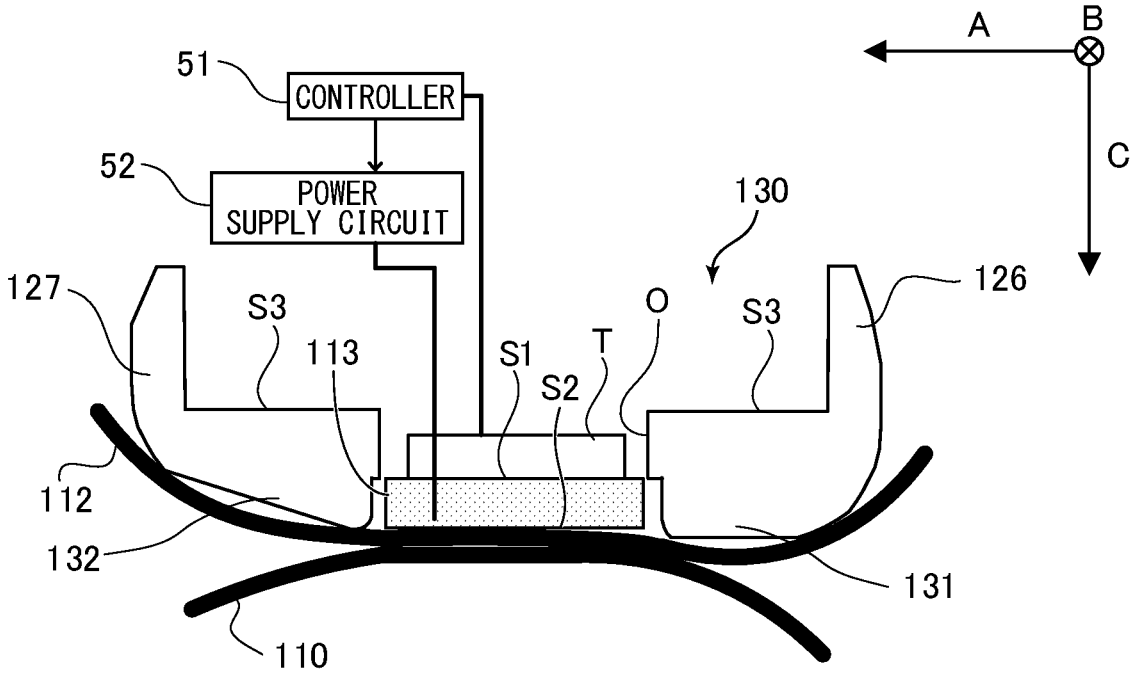

Next, an opening portion O of the heater holder 130 will be described. FIG. 4A is a perspective view of the heater holder 130 as viewed from the heater seating surface S1 side. FIG. 4B is a section view of the fixing apparatus 100 at a portion where a temperature detection element T is provided. That is, FIG. 4B is a section view taken along a plane orthogonal to the longitudinal direction B and along a broken line 4B-4B of FIG. 4A.

As illustrated in FIG. 4A, the heater seating surface S1 of the heater holder 130 has the opening portion O for fitting the temperature detection element T such as a temperature fuse, a thermoswitch, or a thermistor. As illustrated in FIG. 4B, the opening portion O is a hole portion penetrating the heater holder 130 from the heater seating surface S1 to the stay contact surface S3 opposite thereto in the orthogonal direction C. The opening portion O of the heater holder 130 allows the temperature detection element T to be disposed in contact with the heater 113. The temperature detection element T transmits a signal in accordance with the temperature of the heater 113. To be noted, the temperature detection element T may be disposed in the vicinity of the heater 113 without contact, that is, with a predetermined gap therebetween.

By using a temperature fuse or a thermoswitch as the temperature detection element T, a controller 51 of the image forming apparatus 50 can control a power supply circuit 52 for the heater 113 on the basis of the signal of the temperature detection element T to block the power supply to the heater 113. The power supply circuit 52 includes a blocking circuit such as a relay capable of blocking the power supply to the heater 113 on the basis of a command from the controller 51. In this case, the controller 51 and the blocking circuit functions as a blocking portion (safety device) that detects an abnormal temperature rise of the heater 113 and blocks the power supply to the heater 113. In addition, by using a thermistor as the temperature detection element T, the controller 51 can control the amount of power supplied from the power supply circuit 52 to the heater 113 on the basis of the signal of the temperature detection element T. In this case, the controller 51 functions as a temperature controller (temperature adjusting device) that controls the temperature of the heater 113 to a predetermined target temperature.

Here, a peripheral portion of the opening portion O of the heater holder 130 has a lower rigidity than the other portion of the heater holder 130. Therefore, in the present embodiment, as will be described later, reinforcing ribs 123 are provided in the vicinity of the opening portion O on the stay contact surface S3 opposite to the heater seating surface S1.

Figure 5:
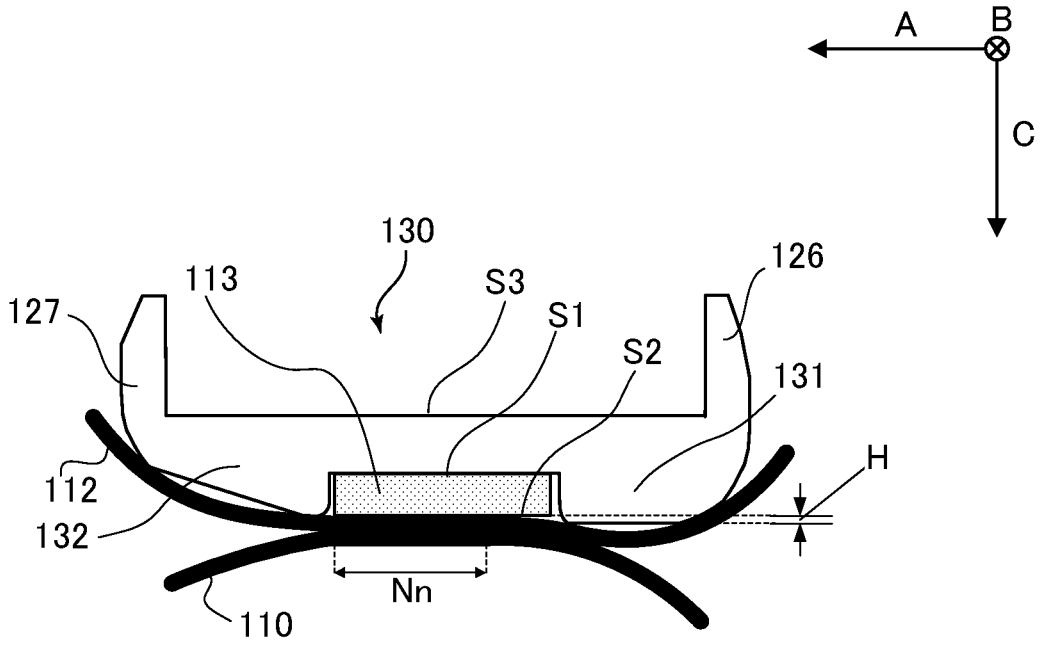
FIG. 5 is a section view of the heater holder according to the first embodiment.

Next, a rotation trajectory of the fixing film 112 regulated by the heater holder 130 will be described. FIG. 5 is a section view of the vicinity of the fixing nip Nf taken at a center portion in the longitudinal direction B.

As described above, the heater holder 130 includes an upstream projection portion 131 projecting toward the pressurizing roller 110 side with respect to the heater seating surface S1 at a position upstream of the heater 113 in the recording material conveyance direction A. The projection height H of the upstream projection portion 131 with respect to the sliding surface S2 of the heater 113 is preferably of a sufficient value for regulating the trajectory of the fixing film 112 such that the fixing film 112 does not contact an edge portion of the heater 113 on the upstream side in the recording material conveyance direction A. However, if the projection height H is set to be too large, the upstream projection portion 131 presses the fixing film 112, and thus the contact width between the inner surface of the fixing film 112 and the heater 113, that is, an inner surface nip width Nn decreases. In this case, heat transmission from the heater 113 to the fixing film 112 is reduced, which can lead to occurrence of a fixation failure.

The projection height H of the upstream projection portion 131 with respect to the sliding surface S2 of the heater 113 is, for example, preferably about 0.1 mm to 0.7 mm, and is 0.2 mm in the present embodiment. In addition, the inner surface nip width Nn is preferably 4 mm or larger, and is 4.2 mm in the present embodiment.

Reinforcing Ribs of Heater Holder

Next, the shape and positional relationship with the pressurizing stay 119 of the reinforcing ribs 123 provided on the heater holder 130 according to the present embodiment will be described.

FIG. 6 is a perspective view of the heater holder 130 as viewed from the side opposite to the heater seating surface S1, and particularly illustrates the vicinity of the opening portion O where the temperature detection element T is disposed in enlarged view. As illustrated in FIG. 6, the reinforcing ribs 123 extending in the recording material conveyance direction A are formed at two positions such that the opening portion O of the heater holder 130 is interposed therebetween in the longitudinal direction B. The reinforcing ribs 123 are each a rib portion, that is, a ridge portion provided to project from the stay contact surface S3 serving as a second surface of the heater holder 130 in the orthogonal direction C and extend in the recording material conveyance direction A serving as the short direction of the heater 113. One of the reinforcing ribs 123 is an example of a first rib portion provided on one side of the opening portion O that is a hole portion of the holder member in the longitudinal direction B, and the other of the reinforcing ribs 123 is an example of a second rib portion provided on the other side of the opening portion O that is a hole portion of the holder member in the longitudinal direction B.

Figure 7:
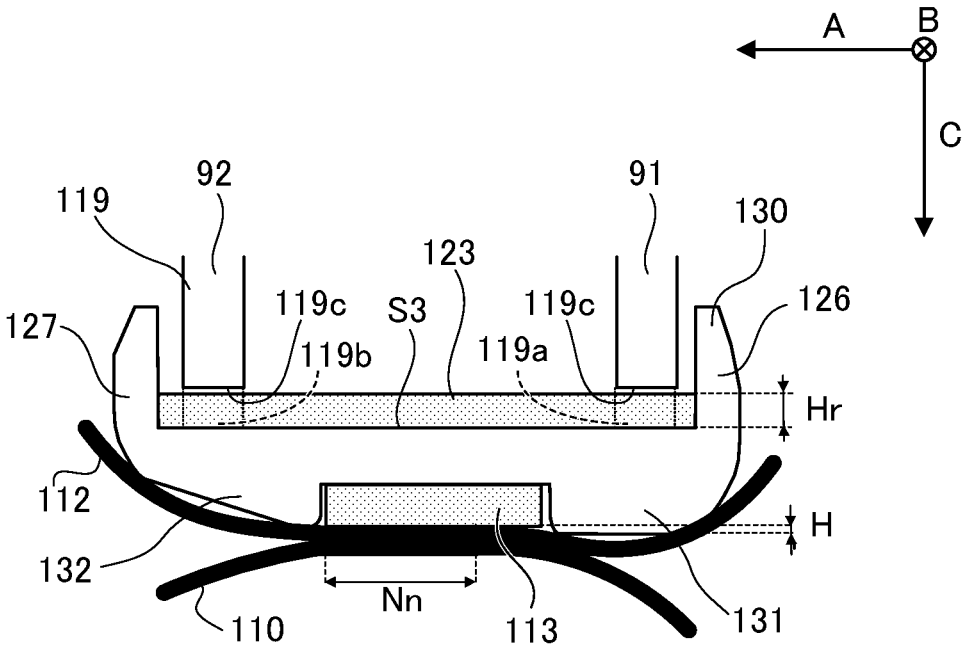
FIG. 7 is a section view of part of the heater holder according to the first embodiment including the rib portion.

FIG. 7 is a section view of the fixing apparatus 100 illustrating a part in the longitudinal direction B where the reinforcing ribs 123 are disposed. As illustrated in FIGS. 6 and 7, the reinforcing ribs 123 of the present embodiment extend in the recording material conveyance direction A so as to interconnect the upstream guide 126 and the downstream guide 127 of the heater holder 130. As a result of the reinforcing ribs 123 interconnecting the upstream guide 126 and the downstream guide 127, the flexural rigidity of the heater holder 130 against the force received from the pressurizing stay 119 and the pressurizing roller 110 is improved. To be noted, the reinforcing ribs 123 may be connected to either ones of the wall portions 124 and the guide ribs 129 of the upstream guide 126 and the downstream guide 127.

Incidentally, the reinforcing ribs 123 have shapes projecting from the stay contact surface S3 of the heater holder 130 to the side opposite to the pressurizing roller 110 in the orthogonal direction C. Therefore, the end portions 119*a* and 119*b* of the pressurizing stay 119 opposing the heater holder 130 are each provided with a cutout portion 119*c* avoiding the reinforcing ribs 123 as illustrated in FIG. 7. The cutout portions 119*c* are recess shapes where part of the end portions 119*a* and 119*b* of the heater holder 130 extending in the longitudinal direction B are recessed toward the side opposite to the pressurizing roller 110 in the orthogonal direction C. That is, the cutout portions 119*c* as the recess portions formed by recessing in a direction away from the stay contact surface S3 serving as a second surface of the heater holder 130 in the orthogonal direction C and extending in the recording material conveyance direction A are provided in the second portion 92 and the third portion 93 of the pressurizing stay 119 serving as a support member. The reinforcing ribs 123 serving as rib portions extend in the recording material conveyance direction A through the cutout portions 119*c*.

In the present embodiment, the height Hr of the reinforcing rib 123 in the orthogonal direction C is set to 1.5 mm, and the width Wr of the reinforcing rib 123 in the longitudinal direction B is set to 2.0 mm. In addition, the height of the cutout portion 119*c* of the pressurizing stay 119 in the recording material conveyance direction A is set to 2.0 mm, and the width of the cutout portion 119*c* in the longitudinal direction B is set to 2.5 mm. As a result of this, contact between the reinforcing ribs 123 and the pressurizing stay 119 is avoided, and thus the pressurizing stay 119 can press the heater holder 130 by a force that is substantially uniform in the longitudinal direction B even in a state in which the reinforcing ribs 123 are provided.

Effects of Present Embodiment

Reduction of creep deformation of the heater holder 130 according to the configuration of the present embodiment will be described with reference to FIGS. 7 to 9.

Figure 8:
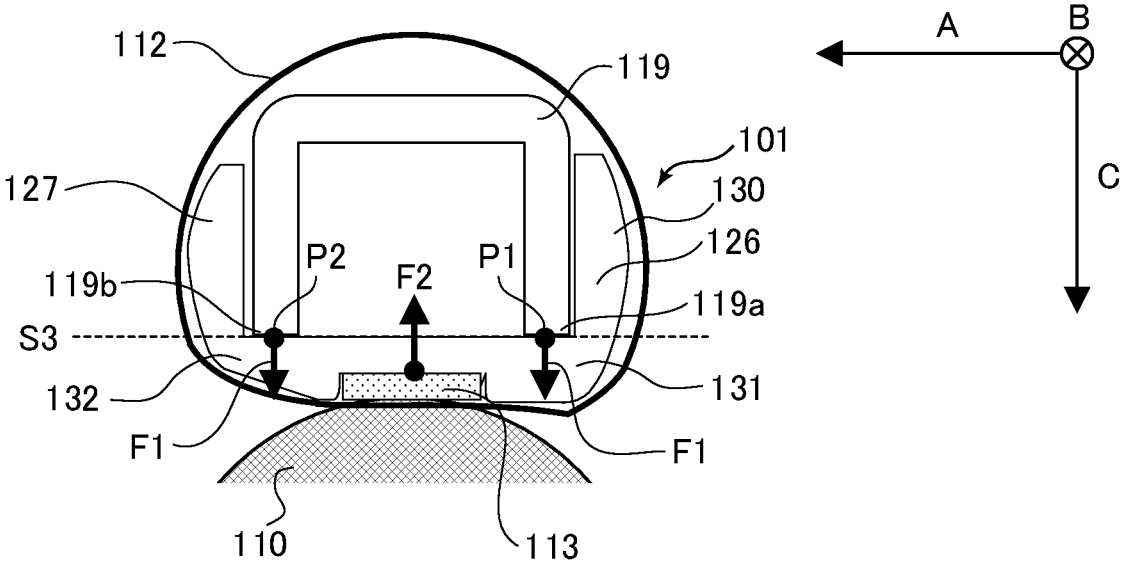
FIG. 8 is a diagram for describing a stress acting on the heater holder.
Figure 9:
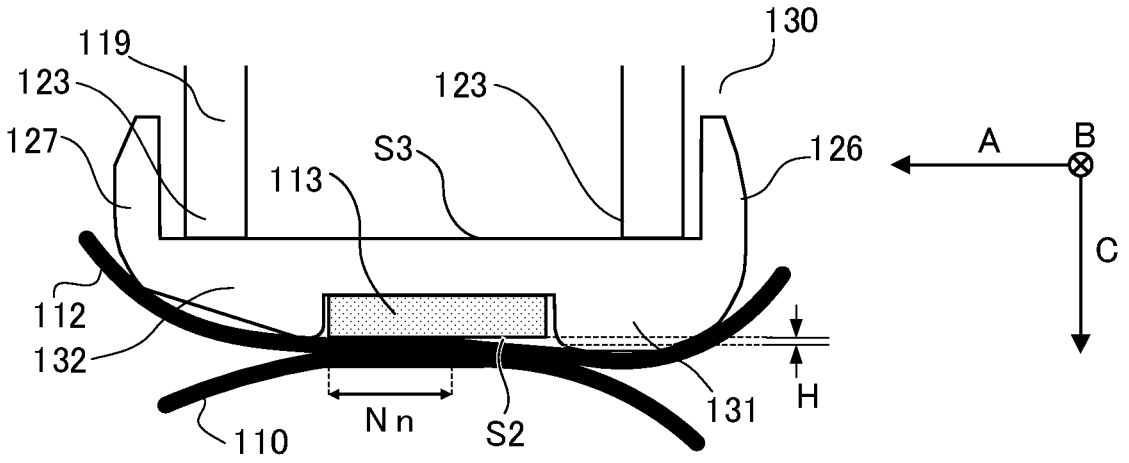
FIG. 9 is a section view of the heater holder in a reference example.

FIG. 8 is a schematic diagram for describing stress acting on the heater holder 130 in a state in which the fixing nip Nf is pressurized. As illustrated in FIG. 8, on the stay contact surface S3, the heater holder 130 receives a force F1 from the end portions 119*a* and 119*b* of the pressurizing stay 119 toward the pressurizing roller 110 side in the orthogonal direction C. In addition, the heater holder 130 receives a force F2 toward a side opposite to the pressurizing roller 110 in the orthogonal direction C as a reaction force received from the pressurizing roller 110 supported by the bearing members 135 via the fixing film 112 and the heater 113.

As a result of this, a bending moment that displaces the heater seating surface S1 toward a side opposite to the pressurizing roller 110 in the orthogonal direction C acts on the heater holder 130 between the contact portions between the pressurizing stay 119 and the heater holder 130, that is, between a first position P1 and a second position P2. In other words, a bending moment that warps the heater holder 130 such that the upstream projection portion 131 and the downstream projection portion 132 are displaced toward the pressurizing roller 110 side in the orthogonal direction C is generated on the heater 113.

If the heater holder 130 is deformed by such a bending moment, the fixing performance of the fixing apparatus 100 can deteriorate.

Next, a case where the heater holder 130 is deformed by the bending moment will be described with reference to a reference example. FIG. 9 is a section view of the fixing apparatus 100 illustrating the vicinity of an opening portion of the heater holder 130 of the reference example, and the heater holder 130 is not provided with the reinforcing ribs 123 of the present embodiment.

As a result of a sheet passing test in which an image is formed on a paper sheet of an LTR (Letter) size by using the image forming apparatus 50 including the fixing apparatus 100 of the reference example, damage to the heater holder 130 and wrinkling of the recording material did not occur. If the mechanical strength or dimensional precision of the heater holder 130 is insufficient, there is a possibility that the heater holder 130 is damaged, or the rotation of the fixing film 112 becomes unstable, which can lead to biased movement of the fixing film 112 and wrinkles of the recording material. Regarding this, it can be considered that sufficient values of mechanical strength and dimensional precision of the heater holder 130 were secured in the fixing apparatus 100 of the reference example.

However, in this reference example, in the case where an endurance test in which images were repeatedly performed on a large number of paper sheets was performed, fixation failures increasingly occurred as the total number of passed sheets increased, and the result gradually became worse. This can be considered to be because the bending moment described above caused creep deformation of the heater holder 130, and thus the inner surface nip width Nn, which was the contact width between the inner surface of the fixing film 112 and the heater 113, decreased. That is, it can be considered to be because the upstream projection portion 131 and the downstream projection portion 132 were displaced toward the pressurizing roller 110 side in the orthogonal direction C with respect to the heater 113, and thus the fixing film 112 was separated from part of the heater 113. When the inner surface nip width Nn decreases, the surface temperature of the fixing film 112 is reduced, and when the surface temperature of the fixing film 112 becomes lower than the lower limit of a temperature range suitable for image fixation, this appears as a fixation failure.

In addition, in the endurance test, the fixation failures occurred at positions corresponding to the vicinity of the opening portion O of the heater holder 130 in the longitudinal direction B. This can be considered to be because the creep deformation of the heater holder 130 was caused by the bending moment described above mainly in the vicinity of the opening portion O where the rigidity was relatively low.

Next, the case of the present embodiment will be described with reference to FIG. 7. As has been described above, the reinforcing ribs 123 provided to project from the stay contact surface S3 and extend in the recording material conveyance direction A are formed on the heater holder 130 of the present embodiment. These reinforcing ribs 123 improve the flexural rigidity of the heater holder 130 against the bending moment that the heater holder 130 receives in the pressurized state in the fixing nip Nf as illustrated in FIG. 8, and make the creep deformation of the heater holder 130 less likely to occur.

Particularly, in the present embodiment, the reinforcing ribs 123 are disposed in the vicinity of the opening portion O of the heater holder 130 in the longitudinal direction B. As a result of this, the flexural rigidity in the vicinity of the opening portion O having a lower rigidity than a portion where the opening portion O is not provided can be improved, and the creep deformation of the heater holder 130 can be effectively reduced.

The reinforcing ribs 123 are preferably provided throughout at least a range where the heater seating surface S1 serving as a first surface is provided in the recording material conveyance direction A. As a result of this, the flexural rigidity of the portion where the thickness of the heater holder 130 in the orthogonal direction C is small due to the space for receiving the heater 113 can be improved by the reinforcing ribs 123, and thus the creep deformation can be reduced.

More preferably, the reinforcing ribs 123 are provided throughout at least a range from the first position P1 to the second position P2 of FIG. 8 in the recording material conveyance direction A. The first position P1 is a position where the end portion 119*a* serving as a first abutting portion of the pressurizing stay 119 abuts the stay contact surface S3 of the heater holder 130 on the upstream side of the heater 113, and the second position P2 is a position where the end portion 119*b* serving as a second abutting portion of the pressurizing stay 119 abuts the stay contact surface S3 of the heater holder 130 on the downstream side of the heater 113. As a result of this, the flexural rigidity of the range where the bending moment derived from the forces F1 and F2 that the heater holder 130 receives from the pressurizing stay 119 and the pressurizing roller 110 acts on the heater holder 130 can be improved by the reinforcing ribs 123, and the creep deformation can be more effectively reduced.

Further preferably, as in the present embodiment, the reinforcing ribs 123 are formed to be continuous in the recording material conveyance direction A from the upstream guide 126 serving as a first guide portion to the downstream guide 127 serving as a second guide portion of the heater holder 130. As a result of this, the flexural rigidity of the heater holder 130 can be further improved, and the creep deformation can be further reduced.

As a result of a sheet passing test in which an image is formed on a paper sheet of an LTR size by using the image forming apparatus 50 including the fixing apparatus 100 of the present embodiment, damage to the heater holder 130 and wrinkling of the recording material did not occur. In addition, also in the case of conducting the endurance test, abnormal images such as fixation failures did not occur, and a state in which fixed images that were uniform throughout the entire region in the longitudinal direction B could be obtained was maintained for a long period. This can be considered to be because the creep deformation of the heater holder 130 was reduced by the reinforcing ribs 123 provided in the vicinity of the opening portion O of the heater holder 130.

To be noted, as a substitute means for reducing the creep deformation by improving the flexural rigidity of the heater holder 130, increasing the thickness of the portion of the heater holder 130 where the heater seating surface S1 and the stay contact surface S3 are provided can be also considered. However, according to this configuration, the heat capacity of the heater holder 130 increases, and thus the activation time of the fixing apparatus 100 becomes longer.

In contrast, by using the reinforcing ribs 123 as in the present embodiment, the flexural rigidity of the heater holder 130 can be improved while suppressing the increase in the heat capacity of the heater holder 130. That is, according to the configuration of the present embodiment, the creep deformation of the heater holder 130 can be reduced while reducing the influence on the activation time of the fixing apparatus 100.

Second Embodiment

A second embodiment of the present disclosure will be described below. As a result of checking an image on a paper sheet of the LTR size after performing the sheet passing test on a paper sheet of an A4 size by using the image forming apparatus 50 including the fixing apparatus 100 of the first embodiment, a slight fixation failure was observed at left and right end portions of the image in some cases. The present embodiment enables further reducing the occurrence of a fixation failure like this.

In the present embodiment, more reinforcing ribs 123 are added to the heater holder 130 used in the first embodiment. The other elements are substantially the same as in the first embodiment. In the description below, elements denoted by the same reference signs as in the first embodiment are assumed to have substantially the same configurations and effects as in the first embodiment, and parts different from the first embodiment will be mainly described.

Reinforcing Ribs of Heater Holder

Figure 10:
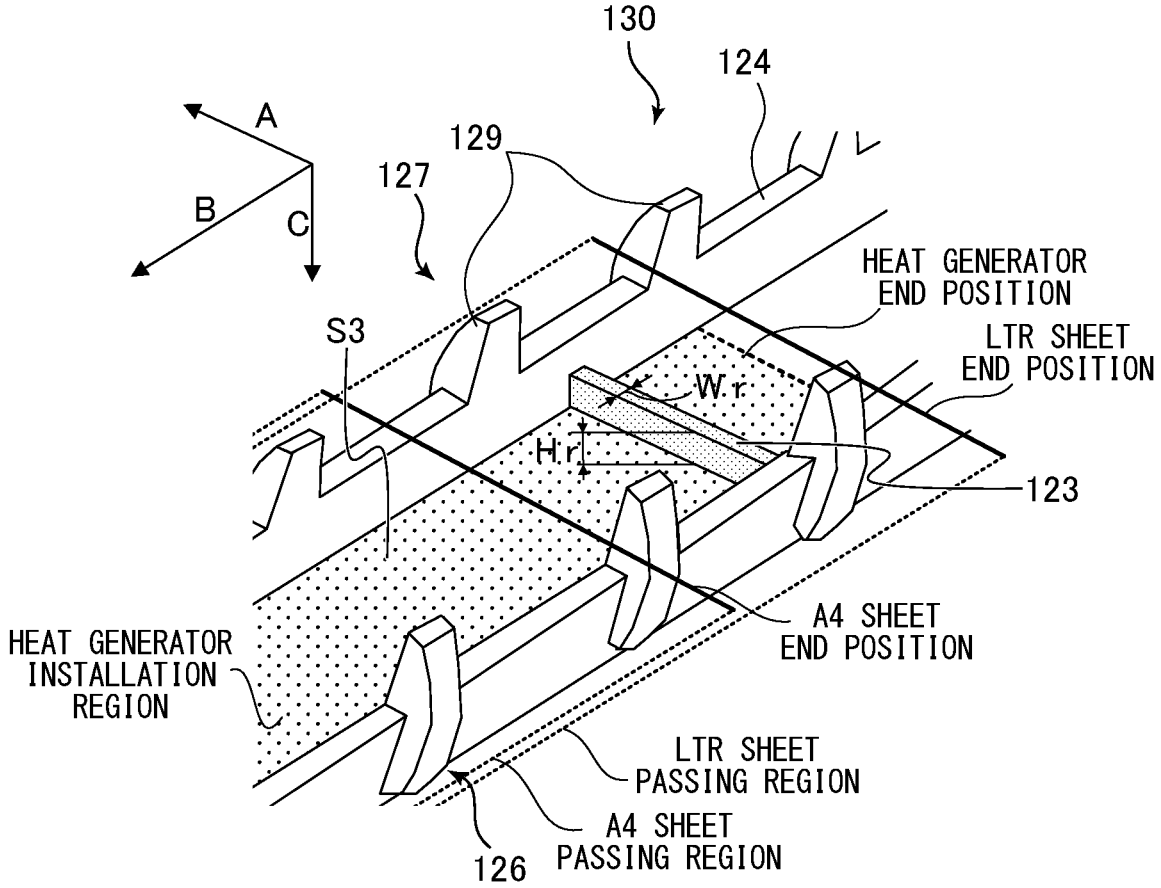
FIG. 10 is a perspective view of part of a heater holder according to a second embodiment.

Reinforcing rib 123 of the heater holder 130 according to the present embodiment will be described with reference to FIG. 10. As illustrated in FIG. 10, the reinforcing ribs 123 added in the present embodiment are disposed between an end portion position of a paper sheet of the A4 size and an end portion position of the heat-generating-resistor on the heater 113 in the longitudinal direction B. That is, the rib portions of the present embodiment are, in the longitudinal direction B, disposed inside a region where the heater 113 generates heat and outside a region that a recording material having a smaller width in the longitudinal direction B than a recording material having the largest width in the longitudinal direction B among recording materials on which the fixing apparatus 100 is capable of forming images passes through.

In the present embodiment, the reinforcing ribs 123 are added to respective positions at 107.5 mm from a position serving as a standard for a center position in the longitudinal direction B of the recording material passing the fixing nip Nf on both sides in the longitudinal direction B. The position serving as the standard for the center position of the recording material will be hereinafter referred to as a conveyance center of the recording material. These positions are set in consideration of the fact that, from the conveyance center of the recording material in the longitudinal direction B, the distance to end portion positions of the paper sheet of the A4 size is 105 mm, and the distance to end portion positions of the heat-generating resistor on the heater 113 is 110 mm.

The reinforcing ribs 123 added in the present embodiment are formed to interconnect the upstream guide 126 and the downstream guide 127 on the heater holder 130 similarly to the reinforcing ribs 123 described in the first embodiment. In the present embodiment, the height Hr of the reinforcing ribs 123 in the orthogonal direction C is set to 1.5 mm, and the width Wr is set to 2.0 mm.

In addition, in accordance with the addition of the reinforcing ribs 123, cutout portions for accepting the reinforcing ribs 123 are added to the pressurizing stay 119. The height of the cutout portions provided in the pressurizing stay 119 in the recording material conveyance direction A is set to 2.0 mm, and the width thereof in the longitudinal direction B is set to 2.5 mm such that the reinforcing ribs 123 do not contact the pressurizing stay 119.

Temperature Rise in Non-Sheet Passing Portion

The fixing apparatus 100 and the image forming apparatus 50 of the present embodiment are capable of performing image formation on at most a paper sheet of the LTR size, which has a width in the longitudinal direction B of 216 mm, similarly to the first embodiment. That is, the paper sheet of the LTR size is a paper sheet of the maximum passable size in the present embodiment. In accordance with this, the width in the longitudinal direction B of the heat-generating resistor on the heater 113 is set to include an effective image region in which an image can be formed on the paper sheet of the maximum passable size.

Here, in the case of performing image formation on a recording material having a smaller width in the longitudinal direction B than the paper sheet of the maximum passable size, that is, in the case of a paper sheet of a small size, there is a region in the fixing nip Nf that the recording material does not pass through and that is heated by the heat-generating resistor. This region will be hereinafter referred to as a non-sheet passing region. Therefore, in the case of successively performing image formation on paper sheets of a small size such as the A4 size, there is a possibility that the surface temperature of the fixing film 112 and the pressurizing roller 110 in the non-sheet passing region becomes higher than in a sheet passing region that the paper sheets of the small size pass through. This is because in the non-sheet passing region, heat is not transmitted to the recording material in the fixing nip Nf, and thus the heat generated by the heat-generating resistor is gradually accumulated. This phenomenon is called "temperature rise in a non-sheet passing portion".

As a result of the temperature rise in the non-sheet passing portion, in the case of successively performing image formation on paper sheets of a small size, the heater holder 130 has a thermal peak in the non-sheet passing region, that is, in a region that is outside the sheet passing region and in a heat-generating region of the heater 113. That is, if the state in which the temperature of heater holder 130 in the non-sheet passing region is higher than in the sheet passing region due to the temperature rise in the non-sheet passing portion continues, there is a possibility that the creep deformation of the heater holder 130 occurs in the non-sheet passing region.

Effects of Present Embodiment

Reduction of the creep deformation of the heater holder 130 in the non-sheet passing region according to the present embodiment will be described. In the present embodiment, since the reinforcing ribs 123 are disposed in the non-sheet passing region of the heater holder 130, the flexural rigidity of the heater holder 130 in the non-sheet passing region is improved. Therefore, in the non-sheet passing region, the creep deformation of the heater holder 130 is not likely to occur even in the case where the forces F1 and F2 and the heat from the temperature rise in the non-sheet passing portion simultaneously act on the heater holder 130 as illustrated in FIG. 8.

As a result of a sheet passing test in which an image is formed on a paper sheet of the A4 size by using the image forming apparatus 50 including the fixing apparatus 100 of the present embodiment, damage to the heater holder 130 and wrinkling of the recording material did not occur. In addition, also in the case of conducting the endurance test, abnormal images such as fixation failures did not occur, and a state in which fixed images that were uniform throughout the entire region in the longitudinal direction B could be obtained was maintained for a long period.

Further, as a result of conducting the sheet passing test of the paper sheet of the LTR size after the endurance test using the paper sheets of the A4 size, the fixation failure neither occurred. This can be considered to be because the reinforcing ribs 123 added in the present embodiment reduced the creep deformation of the heater holder 130 in the non-sheet passing region.

To be noted, although a configuration in which the reinforcing ribs 123 are disposed in the non-sheet passing region in addition to the reinforcing ribs 123 described in the first embodiment has been described as an example in the present embodiment, a configuration in which only the reinforcing ribs 123 in the non-sheet passing region described in the first embodiment are provided may be employed.

Modification Examples

Figure 11A:
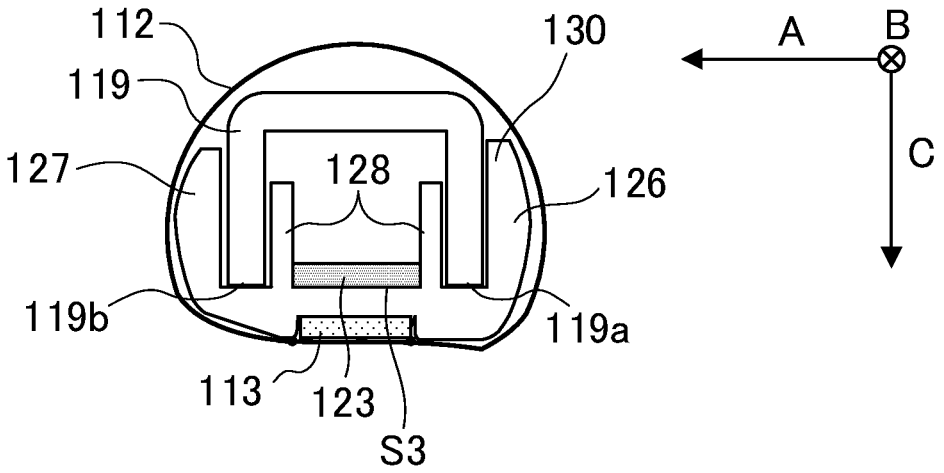
FIGS. 11A to 11C are each a section view of a fixing apparatus according to a modification example.

In the first and second embodiments, the reinforcing ribs 123 are provided to project from the stay contact surface S3 that is flat and provided between the upstream guide 126 and the downstream guide 127 in the recording material conveyance direction A. The configuration is not limited to this, and the reinforcing ribs 123 may be provided also in the case where the surface opposite to the heater seating surface S1 serving as a first surface of the heater holder 130 has recesses and projections as viewed in the longitudinal direction B. For example, as illustrated in FIG. 11A, in the case where two ribs 128 extending in the longitudinal direction B are provided between the upstream guide 126 and the downstream guide 127 of the heater holder 130, a reinforcing rib 123 interconnecting the ribs 128 may be provided. The ribs 128 define recess portions for accepting the end portions 119*a* and 119*b* of the pressurizing stay 119 together with the upstream guide 126 and the downstream guide 127. To be noted, as further modification of FIG. 11A, the reinforcing rib 123 may be configured to penetrate through and extend to the outside of the ribs 128 to connect to the upstream guide 126 and the downstream guide 127.

Figure 11B:
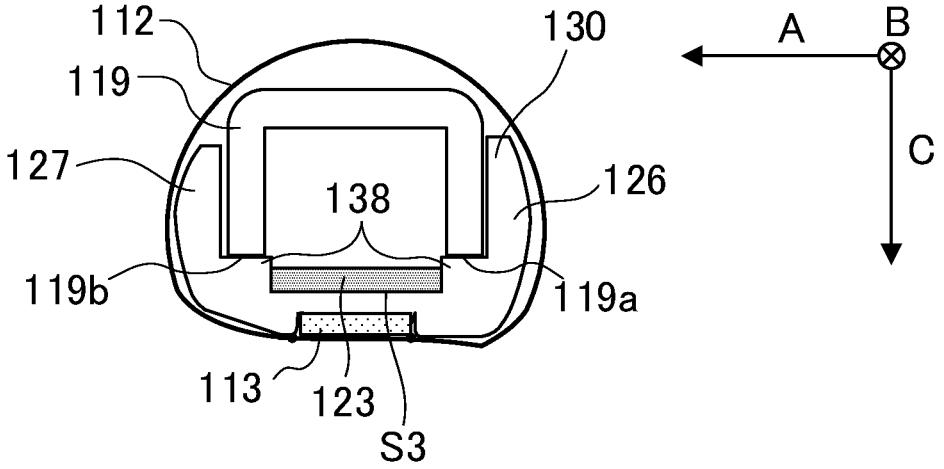

In addition, as illustrated in FIG. 11B, in a configuration in which step portions 138 are provided between the upstream guide 126 and the downstream guide 127 in the recording material conveyance direction A, the reinforcing rib 123 may be formed to interconnect the step portions 138. In this case, since the pressurizing stay 119 abuts the heater holder 130 at the step portions 138, the reinforcing rib 123 is positioned between abutting positions between the pressurizing stay 119 and the heater holder 130, and therefore the pressurizing stay 119 does not need to have the cutout portions.

Figure 11C:
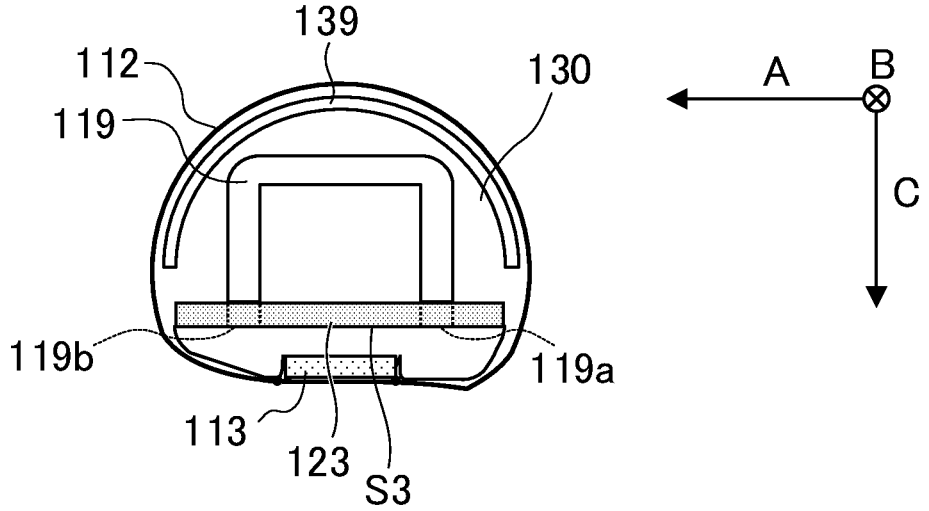

As another modification example, as illustrated in FIG. 11C, a film guide 139 that guides the rotation of the fixing film 112 may be provided separately from the heater holder 130.

The reinforcing ribs 123 illustrated in FIGS. 11A to 11C are examples of a rib portion that is not provided continuously from the upstream guide 126 serving as a first guide portion to the downstream guide 127 serving as a second guide portion of the heater holder 130. Also in these modification examples, as a result of providing the reinforcing rib 123, the flexural rigidity of the heater holder 130 is improved and the creep deformation is reduced, and thus stable fixing performance can be obtained for a long period.

In addition, in the first and second embodiments, the reinforcing ribs 123 disposed in the vicinity of the opening portion O of the heater holder 130 in the longitudinal direction B or in the non-sheet passing region at end portions of the heater holder 130 in the longitudinal direction B have been described above as an example. The arrangement of the reinforcing ribs 123 is not limited to this. For example, a plurality of reinforcing ribs 123 may be disposed at predetermined intervals in the longitudinal direction B. In addition, it suffices as long as at least one reinforcing rib 123 is provided. In any of the modification examples, the flexural rigidity of the heater holder 130 is improved by the reinforcing ribs 123, and therefore the creep deformation of the heater holder 130 can be reduced.

Other Embodiments

In the first and second embodiments described above, a configuration in which a ceramic heater in which a heat-generating resistor is formed on a ceramic substrate is used as the heating portion, that is, the heater of the fixing apparatus, and the fixing film 112 is heated by non-radiant heat of the ceramic heater has been described as an example. The configuration is not limited to this, and a configuration in which a halogen lamp is used as the heater may be employed. That is, a configuration in which a halogen lamp disposed in an inner space of a first rotary member and a sliding member serving as a nip forming portion that is in contact with the inner surface of the first rotary member and receives radiant heat from the halogen lamp to heat the first rotary member are provided as a nip forming unit may be employed. Also in this case, the creep deformation can be reduced by providing a rib portion, that is, a reinforcing rib on a holder member holding the nip forming unit.

In addition, although a configuration in which a film is used as the first rotary member and a roller is used as the second rotary member has been described in the first and second embodiments described above, the combination of the first rotary member and the second rotary member is not limited to this. For example, a roller member may be used as the first rotary member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-159605, filed on Sep. 29, 2021, which is hereby incorporated by reference herein in its entirety.

What is claimed is:

1. A fixing apparatus comprising:

a first rotary member configured to rotate;

a nip forming unit including a heater and a holder member and disposed in an inner space of the first rotary member, the heater having a length in a longitudinal direction thereof larger than a length thereof in a short direction orthogonal to the longitudinal direction, the holder member being configured to hold the heater;

a detection element configured to transmit a signal in accordance with a temperature of the heater, a second rotary member configured to be in a pressure contact with the nip forming unit with the first rotary member therebetween to form a nip portion between the second rotary member and the nip forming unit, the first rotary member and the second rotary member being configured to nip a recording material at the nip portion and convey the recording material from a first side toward a second side in the short direction; and a support member disposed in the inner space of the first rotary member and configured to support the nip forming unit, wherein the holder member includes a first surface configured to support the heater and provided on the nip portion side of the holder member in an orthogonal direction orthogonal to both of the longitudinal direction and the short direction, a second surface provided on a side of the holder member opposite to the first surface in the orthogonal direction and configured to abut a first abutting portion of the support member on the first side in the short direction with respect to the first surface and abut a second abutting portion of the support member on the second side in the short direction with respect to the first surface, and a first rib portion provided to project from the second surface and extend in the short direction throughout at least a range in the short direction where the first surface is provided, wherein the holder member is provided with a hole portion penetrating the holder member from the first surface to the second surface, wherein the detection element is disposed in the hole portion, wherein the first rib portion is provided on one side of the hole portion in the longitudinal direction, and wherein the holder member further includes a second rib portion provided on another side of the hole portion in the longitudinal direction.

2. The fixing apparatus according to claim 1, wherein the first rib portion is provided throughout at least a range from a position of the first abutting portion of the support member to a position of the second abutting portion of the support member in the short direction.

3. The fixing apparatus according to claim 1, wherein the nip forming unit further includes a first guide portion provided on the first side with respect to the nip portion in the short direction, extending toward a side opposite to the nip portion in the orthogonal direction with respect to the second surface, and configured to guide an inner surface of the first rotary member toward the nip portion; and a second guide portion provided on the second side with respect to the nip portion in the short direction, extending toward the side opposite to the nip portion in the orthogonal direction with respect to the second surface, and configured to guide the inner surface of the first rotary member having passed the nip portion, and wherein the first rib portion is provided to be continuous from the first guide portion to the second guide portion in the short direction.

4. The fixing apparatus according to claim 1, further comprising a temperature controller configured to control the temperature of the heater on a basis of the signal of the detection element.

5. The fixing apparatus according to claim 1, further comprising a blocking portion configured to block power supply to the heater on a basis of the signal of the detection element.

6. The fixing apparatus according to claim 1, wherein the first rib portion is, in the longitudinal direction, disposed at a position that is inside a region where the heater generates heat and outside a region that a recording material having a smaller width in the longitudinal direction than a recording material having a largest width in the longitudinal direction among recording materials to which the fixing apparatus is capable of fixing an image passes through.

7. The fixing apparatus according to claim 1, wherein the support member includes a first portion extending in the short direction, a second portion extending in the orthogonal direction toward the holder member from an end portion of the first portion on the first side in the short direction, and a third portion extending in the orthogonal direction toward the holder member from an end portion of the first portion on the second side in the short direction, wherein the first abutting portion is provided at a distal end of the second portion, and wherein the second abutting portion is provided at a distal end of the third portion.

8. The fixing apparatus according to claim 7, wherein each of the second portion and the third portion of the support member is provided with a recess shape defined to recess in a direction away from the second surface in the orthogonal direction and extend in the short direction, and wherein the first rib portion extends in the short direction through the recess shape.

9. The fixing apparatus according to claim 1, wherein the holder member includes an upstream projection portion provided on the first side of the first surface in the short direction, projecting toward the second rotary member side in the orthogonal direction with respect to the first surface, and configured to slide on an inner surface of the first rotary member, and a downstream projection portion provided on the second side of the first surface in the short direction, projecting toward the second rotary member side in the orthogonal direction with respect to the first surface, and configured to slide on the inner surface of the first rotary member, and wherein the upstream projection portion projects toward the second rotary member side in the orthogonal direction with respect to a surface of the nip forming unit that slides on the inner surface of the first rotary member.

10. The fixing apparatus according to claim 1, wherein the heater includes a substrate extending in the longitudinal direction and the short direction, and a heat-generating resistor formed on the substrate, wherein the first rotary member is a tubular film and is heated by non-radiant heat generated by the heat-generating resistor by power supply to the heater, and wherein the fixing apparatus is configured to fix an image to the recording material by heating the image by the film heated by the heater while nipping and conveying the recording material by the film and the second rotary member in the nip portion.

11. An image forming apparatus comprising:

an image forming portion configured to form a toner image on a recording material; and the fixing apparatus according to claim 1 configured to fix the toner image formed by the image forming portion to the recording material.

* * * * *